US009540991B1

(12) United States Patent
Talbert

(10) Patent No.: US 9,540,991 B1
(45) Date of Patent: Jan. 10, 2017

(54) COMPOSITIONS AND METHODS TO REDUCE GLOBAL WARMING CAUSED BY GASOLINE AND SPARK IGNITED INTERNAL COMBUSTION ENGINES

(71) Applicant: William L. Talbert, York, PA (US)

(72) Inventor: William L. Talbert, York, PA (US)

( * ) Notice: Subject to any disclaimer, the term of this patent is extended or adjusted under 35 U.S.C. 154(b) by 0 days.

(21) Appl. No.: 14/874,570

(22) Filed: Oct. 5, 2015

(51) Int. Cl.

| | |
|---|---|
| ***F02B 41/00*** | (2006.01) |
| ***F02B 5/02*** | (2006.01) |
| ***C10L 1/06*** | (2006.01) |

(52) U.S. Cl.
CPC ..... *F02B 41/00* (2013.01); *C10L 1/06* (2013.01); *F02B 5/02* (2013.01); *C10L 2200/0423* (2013.01); *C10L 2230/22* (2013.01); *C10L 2270/023* (2013.01)

(58) Field of Classification Search
CPC ..... C10L 1/06; C10L 2200/0423; C10L 2270/023;C10L 2230/22; F02B 41/00; F02B 5/02
See application file for complete search history.

(56) References Cited

U.S. PATENT DOCUMENTS

| | | | | |
|---|---|---|---|---|
| 4,955,332 | A | 9/1990 | Talbert | |
| 5,015,356 | A * | 5/1991 | Talbert | F02B 41/00 208/17 |
| 5,259,851 | A | 11/1993 | Genova et al. | |
| 2003/0204986 | A1 * | 11/2003 | Talbert | C10L 1/023 44/300 |

* cited by examiner

*Primary Examiner* — Jacob Amick
(74) *Attorney, Agent, or Firm* — Bacon & Thomas, PLLC

(57) ABSTRACT

Combustion charge compositions comprised of a gasoline-like fuel and air for use in spark ignited internal combustion engines and methods to reduce global warming are described.

8 Claims, No Drawings

COMPOSITIONS AND METHODS TO REDUCE GLOBAL WARMING CAUSED BY GASOLINE AND SPARK IGNITED INTERNAL COMBUSTION ENGINES

BACKGROUND OF THE INVENTION

In the world today the problem of "global warming" has reached catastrophic levels and the cause of this phenomenon has been identified as excessive carbon levels in the atmosphere. This invention relates to gasoline composition changes that will lower carbon levels in the atmosphere and facilitate new methods of fuel use that further reduce these carbon levels.

Gasoline and spark ignited internal combustion engines in use today cause global warming by contributing to the atmosphere:

1. Hydrocarbons from gasoline evaporation.
2. Hydrocarbons from incomplete combustion.
3. Carbon monoxide from incomplete combustion.
4. Carbon dioxide from complete combustion.
5. Carbon dioxide from fires started by hot catalytic converters. These fires also kill plant life that consumes $CO_2$.
6. Nitrous oxides from gasoline combustion that kills trees, a prime consumer of carbon dioxide.

Early work by Talbert, documented in U.S. Pat. No. 4,955,332 (1990), U.S. Pat. No. 5,015,356 (1991), and U.S. Pat. No. 5,312,542 (1994), defined the boiling point range so as to allow gasoline to burn homogeneously with air in an internal combustion engine. The secret to the invention was simple—by using gasoline that is composed primarily of hydrocarbon volatiles which have a final boiling point of 345° F., the fuel will tend to vaporize more readily when mixed with air at ambient conditions. This permits the front end volatility (Reid vapor pressure) to be lowered and a more uniformly mixed vapor and air mixture to enter the combustion chamber. If there are too many heavy components (boiling points greater than 345 degrees F.), as defined in U.S. Pat. No. 5,312,542, they will not completely vaporize and will result in microscopic oil droplets.

These droplets burn more slowly and under fuel rich conditions. This results in higher emission of unburned hydrocarbons and carbon monoxide as well as increasing engine "knock" tendency. Vapor-liquid-equilibrium models of the Talbert fuel showed that its superior performance was indeed related to its uniform vaporization.

Realizing that the combination of higher volatility and fast burn were inherent in the Talbert fuel, Talbert then concluded that the high spark advance and/or high compression in the engines were no longer needed to volatilize his fuel and that this fuel would actually perform better at lower octane levels. This led to U.S. Pat. No. 6,007,589.

There were also earlier efforts by Luke, Progue, Ogle, and Gilbert to increase the vehicle miles per gallon of gasoline or fuel efficiency by increasing the air to fuel ratio.

This was successfully done by heating the engine induction air to vaporize more of the gasoline than was provided by its front end volatility. Heating of this air, however, caused a loss in volumetric efficiency which was unacceptable. Current vehicle engines using current gasoline operate at about 15:1 air to fuel ratio by weight to achieve reliable ignitions at ambient conditions. Going leaner or above an 18:1 air to fuel ratio by weight caused the engines to misfire; a condition of unsatisfactory ignition.

Talbert's early gasoline patents were done years before the cause of global warming was determined. It was only after he discovered a faster burning gasoline composed of a high percentage of hydrocarbon volatiles and having a low octane number (R+M)/2 could achieve reliable ignition at unusually high air to fuel ratios, that he realized this discovery and much of his prior work represented in compositions and methods were new solutions to the problem of global warming caused by gasoline and spark ignited internal combustion engines.

SUMMARY OF THE INVENTION

Shortly after U.S. Pat. No. 6,007,589 issued, Talbert discovered that a gasoline containing over 95% by weight of hydrocarbon volatiles having a final distillation temperature of 345° F., having an octane number (R+M)/2 range from 70 to 82, Reid vapor pressure ranges of 6-9 psi (summer) and 9-12 psi (winter) and no oxygenates would permit ambient air to fuel ratios by weight to be doubled over current gasoline in current engines and the exhaust pollutants to be substantially reduced. See Example 3. This discovery and his prior work as it relates to global warming is the foundation of this invention. The prime objective of the invention is to maximize the reduction of global warming caused by gasoline and spark ignited internal combustion engines. Therefore, the invention must address:

1. Unburned hydrocarbons from gasoline evaporation.
2. Unburned hydrocarbons from incomplete combustion.
3. Carbon monoxide from incomplete combustion.
4. Carbon dioxide from complete combustion.
5. Nitrous oxides from high combustion temperatures and slow burn kills trees that consume carbon dioxide.
6. Carbon dioxide from fires started by hot catalytic converters also kills trees and other vegetation that consume carbon dioxide.

The invention is a fuel composition with air that forms a novel combustion charge composition for lowering global warming caused by gasoline and spark ignited internal combustion engines.

Therefore, to lower gasoline evaporation, the Reid vapor pressure must be lowered which then lowers the front end volatility of the gasoline. To make up for this loss, the gasoline must contain a higher percentage of hydrocarbon volatiles falling in the $C_5$ to $C_{10}$ range. To reduce incomplete combustion requires a faster burn, provided by a higher percentage of hydrocarbon volatiles, lower octane numbers and excess air.

To lower complete combustion requires a higher fuel combustion efficiency achieved by a combustion charge composition of the gasoline containing a higher weight percentage of hydrocarbon volatiles, a lower octane number, and excess air. This gasoline facilitates reliable ignition at very high air to fuel ratios under ambient conditions thereby allowing the fuel to be regulated into the induction air of spark ignited internal combustion engines. The amount of fuel injected into the induction air of an engine will always be the minimum required to satisfy the varying horsepower demand on the engine but will never exceed a stoichiometric balance of air to fuel at any time. To lower nitrous oxides requires a faster burn and lower combustion temperatures or a gasoline composition having a higher percentage of hydrocarbon volatiles and a lower octane number than current gasoline, and burning at air to fuel weight ratios in excess of 18:1 most of the time which lowers exhaust temperatures.

To lower catalytic converter temperatures requires less gasoline be burned by improving fuel combustion efficiency so that more fuel is burned in the engine and less is burned in the catalytic converter, by faster burning and lower engine exhaust temperatures from running engines most of the time at air to fuel weight ratios in excess of 18:1.

DETAILED DESCRIPTION OF THE INVENTION

The composition of the gasoline is determined by its specifications which includes composition and its properties. Therefore, the gasoline of this invention must include both of the following:

1. Over 95 weight percent of the gasoline is liquid hydrocarbon volatiles—necessary for rapid combustion, reliable high air to fuel weight ratio ignition and lower Reid vapor pressures.
2. An octane number (R+M)/2 range of 70 to 82 for rapid combustion so more fuel is burned in the engine and less is burned in the catalytic converter.

The gasoline specification of this invention can also include:

3. Reid vapor pressure ranges of 6-9 psi (summer) and 9-12 psi (winter) to lower evaporative emissions.
4. No oxygenates to improve rate of combustion and energy density.

Items 3 and 4 above would require government approval as both a higher Reid vapor pressure and oxygenates are required by law in current gasoline. However, the enclosed examples show that the fuel of this invention is safe and lowers global warming more with lower Reid vapor pressure and no oxygenates. Therefore, these changes must be reflected in the claims of this invention.

The combustion charge composition of this invention would then include a modified gasoline of this invention in variable amounts combined with ambient air falling within an air to fuel weight ratio range of 15:1 to over 30:1 to improve fuel combustion efficiency, lower engine exhaust temperatures and lower exhaust pollutants.

A combustion charge composition having a wide air to fuel weight ratio range with reliable ignition is ideal for:

1. A fixed setting such as idle or speed control where engine speed can be increased, decreased or maintained by changing the air to fuel ratios of the combustion charge.
2. Variable power such as operator demand can often be satisfied just by changing the air to fuel ratio of the combustion charge.

In example one, a car was cold started with a modified gasoline having a Reid vapor pressure of 6 psi with no explosive effects. It is therefore obvious that the flammability limit of gasoline could be lowered to less than 6 psi with the modified gasoline. This faster burning gasoline would cause current engines with high spark advance to "knock" except current engines are equipped with knock sensors that immediately correct the problem by retarding the spark advance. Older engines without knock sensors would require the spark advance be retarded manually. All three examples included herein demonstrate the ability of the modified gasoline to perform equal to or better than current gasoline in current vehicles. Also the exhaust emissions of carbon in example 3 are lower than from using current oxygenated gasoline to fuel current engines. Oxygenating gasoline of this invention is not needed for the octane boost it provides, for reducing carbon emissions, or for extending volumes. It only makes the gasoline more corrosive and less efficient because of its lower heating value. Also if ethanol causes oxidation of iron, one might question its contribution to liquid phase oxidation of gasoline in long term storage which would lower the heating value of the gasoline. Ethanol also raises the octane level of the gasoline which slows up the rate of combustion. Therefore, if all the carbon that is emitted into the atmosphere from planting, harvesting, transporting and processing corn to make ethanol in addition to shipping the ethanol to various distribution centers where it is mixed with gasoline is considered in addition to the negative effects it has on gasoline from a global warming point of view, then putting it in the gasoline of this invention will only contribute to global warming.

The modified gasoline (of this invention) has a lower energy density than current gasoline yet provides equivalent power with less gasoline because more of the fuel is burned in the engine (see example 1). This fuel when used in spark ignited internal combustion engines without catalytic converters will also provide another way to reduce "global warming" as many engines (farm, home, and commercial) fall in this category.

In order to maximize the reduction of "global warming" caused by gasoline and spark ignited internal combustion engines or to achieve the object of this invention requires that current gasoline specifications be modified and combined with the reliable high air to fuel ratio ignition discovery to form a novel combustion charge composition for spark ignited internal combustion engines. The combustion charge composition would then contain variable amounts of the modified gasoline plus the following air composition.

For low power an engine can operate with reliable ignition at over 30:1 air to fuel weight ratio and for high power this engine can operate with reliable ignition at 15:1 air to fuel weight ratio using the combustion charge composition of this invention. Therefore, in applications where intermittent power is required such as in vehicles, having the ability to regulate the amount of fuel injected into the induction air of the engines based on power required will conserve gasoline. This is very important to global warming because the less carbon that goes into the engine, the less carbon will be exhausted from the engine.

In today's spark ignited internal combustion engines, high compression and/or high spark advance are used to vaporize current gasoline. This uses gasoline. The modified gasoline of this invention vaporizes more readily and requires less compression and/or spark advance to vaporize. This saves gasoline and lowers global warming.

The gasoline part of the combustion charge of this invention may contain other compositions and/or properties in its specification for other purposes not in conflict with this invention.

I claim:

1. A combustion charge composition for use in spark ignited internal combustion engines with said composition being comprised of a gasoline type fuel and air wherein said fuel contains as part of its specification:

a. 95 to 100 percent by weight of liquid hydrocarbon volatiles;
b. an octane number (R+M)/2 range of 70 to 81; and
c. Reid vapor pressure ranges of 6 psi or less (summer) and 6 psi or more (winter) both depending on ambient conditions, and wherein said air is ambient air falling within a variable air to fuel weight ratio range of 15:1 to over 30:1.

2. A method to lower global warming comprising one or more of the following:

(a) lowering global warming by using the composition of claim 1 but further limiting the oxygenate level to 5 percent by weight or less;

(b) lowering global warming caused by gasoline and spark ignited internal combustion engines by regulating the amount of the fuel of claim 1 that is injected into the air of said composition of claim 1 within a variable air to fuel ratio range of 15:1 to over 30:1 based on the power demand on said engines;

(c) lowering global warming caused by gasoline and spark ignited internal combustion engines by regulating the amount of the fuel of claim 1 that is injected into the air of said composition of claim 1 within a variable air to fuel ratio range of 15:1 to over 30:1 based on the power demand on said engines but further limiting the oxygenate level to 5 percent by weight or less;

(d) lowering global warming by using the fuels of claim 1 which require less energy to vaporize than current gasoline; and (e) lowering global warming by reducing exhaust pollutants from small spark ignited internal combustion engines or other spark ignited internal combustion engines not having catalytic converters by using the combustion charges of claim 1.

3. The method of claim 2, wherein said method comprises lowering global warming by using the composition of claim 1 but further limiting the oxygenate level to 5 percent by weight or less.

4. The method of claim 2, wherein said method comprises lowering global warming caused by gasoline and spark ignited internal combustion engines by regulating the amount of the fuel of claim 1 that is injected into the air of said composition of claim 1 within a variable air to fuel ratio range of 15:1 to over 30:1 based on the power demand on said engines.

5. The method of claim 2, wherein said method comprises lowering global warming caused by gasoline and spark ignited internal combustion engines by regulating the amount of the fuel of claim 1 that is injected into the air of said composition of claim 1 within a variable air to fuel ratio range of 15:1 to over 30:1 based on the power demand on said engines but further limiting the oxygenate level to 5 percent by weight or less.

6. The method of claim 2, wherein said method comprises lowering global warming by using the fuels of claim 1 which require less energy to vaporize than current gasoline.

7. The method of claim 2, wherein said method comprises lowering global warming by reducing exhaust pollutants from small spark ignited internal combustion engines or other spark ignited internal combustion engines not having catalytic converters by using the combustion charges of claim 1.

8. A method to lower the external temperatures of catalytic converters by using the combustion charges of claim 1.

* * * * *